US006727030B2

(12) United States Patent
Nakamura et al.

(10) Patent No.: US 6,727,030 B2
(45) Date of Patent: Apr. 27, 2004

(54) TONER AND AN IMAGE FORMATION METHOD

(75) Inventors: Yasushige Nakamura, Kawasaki (JP); Seijiro Ishimaru, Kawasaki (JP); Mutsuo Watanabe, Inagi (JP); Yoshimichi Katagiri, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/303,073

(22) Filed: Nov. 25, 2002

(65) Prior Publication Data

US 2003/0165763 A1 Sep. 4, 2003

Related U.S. Application Data

(63) Continuation of application No. PCT/JP00/03366, filed on May 25, 2000.

(51) Int. Cl.[7] ..... G03G 9/09

(52) U.S. Cl. ..... 430/108.21; 430/108.6; 430/108.1; 430/109.4; 430/108.4; 430/108.2

(58) Field of Search ..... 430/108.21, 108.2, 430/108.6, 108.1, 108.4, 109.4

(56) References Cited

U.S. PATENT DOCUMENTS

| | | | | | |
|---|---|---|---|---|---|
| 4,229,512 | A | * | 10/1980 | Lenhard et al. | 430/108.14 |
| 4,426,436 | A | * | 1/1984 | Lewis et al. | 430/137.21 |
| 4,668,501 | A | * | 5/1987 | Shibuta et al. | 423/608 |
| 5,811,213 | A | | 9/1998 | Chiba | |
| 6,391,508 | B2 | * | 5/2002 | Hattori | 430/108.6 |
| 2002/0146631 | A1 | * | 10/2002 | Nakamura et al. | 430/109.4 |

FOREIGN PATENT DOCUMENTS

| | | | | | |
|---|---|---|---|---|---|
| JP | 5-346681 | | | 12/1993 | |
| JP | 6-332233 | | | 12/1994 | |
| JP | 9-22148 | | | 1/1997 | |
| JP | 9-329912 | | | 12/1997 | |
| JP | 10-123760 | | | 5/1998 | |
| JP | 11-218960 | | | 8/1999 | |
| JP | 2002072566 | A | * | 3/2002 | G03G/9/09 |
| WO | WO99/13382 | | | 3/1999 | |

OTHER PUBLICATIONS

"Application Technologies of Advanced Pigments" ("Kinousei Ganryou no Gijutsu to Ouyou Tenkai"), Tokyo CMC, Nov. 20, 1998, p. 30/See Search Report.

* cited by examiner

*Primary Examiner*—Christopher Rodee
(74) *Attorney, Agent, or Firm*—Westerman, Hattori, Daniels & Adrian, LLP

(57) ABSTRACT

A toner has a surface to which a titanium black fine particle adheres, the titanium fine particle having a property of being changed in color from black to white by flash-light.

8 Claims, No Drawings

TONER AND AN IMAGE FORMATION METHOD

This application is a continuation of international application PCT/JP00/03366, filed on May 25, 2000.

TECHNICAL FIELD

The present invention relates to a toner for electrophotography used in an electrophotographic copying machine, an electrophotographic facsmile, and an electrophotographic printer, etc., and in particular, relates to a toner preferable for carrying out fixing by flash light.

Since fixing of a toner image on a recording medium is performed without applying pressure to the toner in an electrophotographic apparatus for performing image formation using flash light, there is a great need for a color toner that is well melted by efficiently utilizing energy from the flash light.

BACKGROUND ART

An electrophotographic method that has been conventionally and broadly adopted includes respective processes of (1) electrostatically charging of a photoconductor, (2) light exposure of the photoconductor (formation of a latent image), (3) development of the latent image by a toner, (4) transcription of the toner image to a recording medium, and (5) fixing of the toner image on the recording medium.

Among these, as a fixing method for a toner image, a heat-roll method such that the toner is heated directly between heated rollers, a oven-fixing method, and a flash-fixing method such that fixing is performed by light irradiation and far-infrared-ray irradiation are well known.

Among the fixing methods, the heat-roll method is most broadly adopted. In this heat-roll method, since a simple configuration is provided such that fixing is accomplished by heating and directly applying pressure to the toner by the rollers at high temperature, there are advantages in that the apparatus is inexpensive and a surface for fixing the toner can be made flat. On the contrary, there are many known problems in that a paper (recording medium) after fixing becomes rolled, dirt on the paper is easily generated by an offset since toner dirties the surfaces of the fixing rollers, ultra-speeding up is difficult because of the rolling of the paper, and fixing to a special recording medium such as a sealable postcard is difficult, etc.

In contrast to the heat-roll method, the flash-fixing method, which fixes the toner without any contact, is free of the problem of paper rolling or offset and also easy to adapt for speeding up and the sealable postcard, thus being used for business high-speed printers and high-speed copying machines.

In the flash-fixing method, when the toner used is black, fixing can be performed relatively easily by making the temperature on the outermost surface of a toner particle equal to or more than 200° C. However, in the case of a color toner, since flash light is transmitted, the temperature of the outermost surface may be equal to or more than 100° C., so that the situation occurs in which it is not certain that fixing will be carried out.

By the way, an external additive is commonly added to the surface of the toner particle for the purpose of improving fluidity an d the electrostatic property of the toner. As this external additive, it is common to use a white fine particle such as titanium oxide, silica, alumina, etc. However, in the case of flash-fixing, since these white particles of external additives further reflect flash light, the fixing property of the toner is further degraded. Furthermore, a black external additive is also needed for the black toner in view of preventing the fixing property from degrading.

Also, with regard to a color toner, the method of adding an infrared-ray absorbent is known so that fixing by flash light is carried out with certainty (for example, see Japanese Laid-Open Patent Application No. 7-191492). However, since such an infrared-ray absorbent is expensive and also it is difficult to produce an effective infrared-ray absorbent, it is desired to decrease it as much as possible.

Then, as a countermeasure to the problem for the white external additives and the decrease in the infrared-ray absorbent, a proposition of a technique for improving the fixing property by employing black external additives such as carbon black etc. has been made so as to enhance the efficiency for energy absorption, but in the case of the color toner, there occurs the problem that the color becomes turbid after fixing and thus they cannot simply be employed.

Furthermore, although a technique employing titanium black as an external additive is proposed in Japanese Laid-Open Patent Application 6-332233, in the case of the color toner, there is the problem that the color becomes turbid after fixing and there is also a problem of the toner lacking in environmental stability.

Accordingly, it is a main object of the present invention to provide a toner of which fixing can be performed efficiently and certainly by flash light, with environmental stability.

DISCLOSURE OF THE INVENTION

The above object is achieved by a toner having a surface to which a titanium black fine particle adheres which fine particle has a property of being changed in color from black to white by flash light, according to the present invention.

According to the invention described above, when fixing is performed by the flash light, since the titanium black fine particle of a black color adheres to the surface of the toner particle, light energy is converted into heat efficiently so that the toner is fixed on a recording medium and the titanium black fine particle changes color from black to white by the temperature rise thereat. Thus, the problem that an image after fixing is black and turbid is resolved. Moreover, in the case of the color toner, the advantage in that the amount of the infrared-ray absorbent can be decreased occurs.

It is preferable that for the toner the titanium black fine particle be subjected to a hydrophobicity-providing treatment with a titanate-based, silicone-based, or aluminum-based coupling treatment agent. According to such a toner, since the titanium black fine particle is subjected to a hydrophobicity-providing treatment, the environmental stability of the toner is improved and a good electrostatic property can be maintained over a long period.

Also, it is preferable that for the toner an average first-order particle diameter of the titanium black fine particles be 0.005 through 0.04 $\mu$m. Titanium black is represented by the general formula $Ti_nO_{(2n-1)}$, and one of which the first-order particle diameter is 0.005 through 0.04 $\mu$m is preferred as an external additive to a toner for flash-fixing since the color changes from black to white at a temperature equal to or less than 200° C.

Also, it is preferable that for the toner, the color changing temperature from black to white be within a range of 70° C. through 200° C. Such a toner can be whitened in a broad range of energy of the flash light. Such a titanium black fine particle can be produced by adjusting a lattice defect of a titanium black crystal and the particle diameter.

Also, it is preferable for the toner to contain at least a polyester resin of which a raw material is an alkylene oxide adduct of bisphenol A represented by the following formula (1):

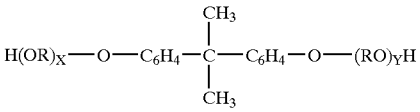

(1)

(In the formula described above, R represents an ethylene or propylene group and X, Y represent integers equal to or more than 1, respectively.)

As a polyester resin including the monomer as described above is employed as a binder resin for the toner, a more preferable toner can be provided since there is a little decomposed product and little odor is generated in the fixing by the flash light.

Also, it is preferable for the toner to contain 0.01 through 10 parts by weight of a compound represented by the following formula (2):

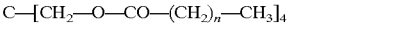

(2)

per 100 parts by weight of a binder resin (n is an integer equal to or more than 14.)

Since the compound described above functions as a fixing auxiliary and improves the flash-fixing property of the toner, containing a certain amount in the toner is preferred.

Also, in the toner, when this is a color toner, an infrared-ray absorbent may be further contained. For this infrared-ray absorbent, its amount can be decreased compared to the conventional case.

Then, it is recommended that the infrared-ray absorbent be one selected from the group including aminum, diimmonium, naphthalocyanine, and tin oxide. These are recommended in that the efficiency of infrared absorption is good, in particular, diimmonium is recommended.

Moreover, the present invention includes an image formation method including a process of fixing a toner image on a recording medium onto a surface thereof by flash exposure, in which energy of the flash light is 0.5 through 3.0J/cm$^2$, its luminous time is 500 through 3000 $\mu$s, and a toner having a surface to which a titanium black adheres is employed, which titanium black is subjected to a hydrophobicity-providing treatment and changed in color from black to white by the flash light.

According to the image formation method as described above, high quality image formation can be performed efficiently by utilizing the color change of titanium black.

BEST MODE FOR CARRYING OUT THE INVENTION

The toner according to the present invention will be explained in more detail below. The toner according to the present invention is a novel toner containing a titanium black fine particle that changes color from black to white at a certain temperature, as an external additive. The special titanium black fine particle as described above adheres (is externally added) to the surface of the toner particle, so that flash light can be converted into heat efficiently and the fixing property can be improved. Although the categories of the toner mentioned in the present invention include a black toner and a color toner, particularly for a color toner, its significant effect can be obtained.

Herein, the general formula for the titanium black fine particle can be represented by $Ti_nO_{(2n-1)}$ (n is an integer equal to or more than 1.) Titanium black has a property that the greater the amount of lattice defect in the crystal and the smaller its particle diameter, the easier changing to white is at low temperature. A temperature range in which titanium black whitens is broad and approximately 70 through approximately 500° C. However, when fixing of the toner is performed by flash exposure, the temperature of the toner is not more than 200° C. In general, raising to a temperature above this one is not preferred in view of decreasing light energy. Thus, it is recommended to employ the titanium black fine particle (crystal) changing color from black to white at 70° C. through 200° C.

Also, from the viewpoint of externally adding the titanium black fine particle to the surface of the toner particle, it is desired that the first-order particle diameter be 0.005 through 0.1 $\mu$m and the specific surface area be 10 through 100 m$^2$/g. When the first-order particle is larger than 0.1 $\mu$m retention on the toner surface is difficult; to the contrary, when less than 0.005 $\mu$m, cohesion is strong so that liberation occurs as external addition to the toner is made and the service life of the toner is shortened.

Also, as described above, although color changing temperature to white of the titanium black fine particle is generally determined by the state of the lattice defect and its particle diameter, in the case of specifying the particle diameter, the whitening occurs with certainty at or below 200° C. in the case of the first-order particle diameter being 0.005 through 0.04 $\mu$m. Hence, the first-order particle diameter of the titanium black fine particle is recommended to be 0.005 through 0.04 $\mu$m for the condition of the external addition and the condition of the whitening.

As understood from the above description, when the titanium black fine particle in a black color adheres to the surface of a color toner particle and is employed as an external additive, since the flash light is absorbed efficiently and converted to heat the fixing property can be improved, and since the titanium black fine particle changes color to white in time with its fixing the problem of the color turbidity after fixing does not occur.

Also, when such a titanium black fine particle is employed for a black toner, silica, titanium oxide, and alumina, etc. that are white and conventionally used are eliminated or decreased so that the fixing property can be improved.

Moreover, it is recommended that the titanium black fine particle be subjected to hydrophobicity-providing treatment from the view of improving environmental stability. It is preferable that the hydrophobicity-providing treatment on the titanium black fine particle be performed by employing a titanate-based, silicone-based, or aluminum-based coupling treatment. Although a toner can be maintained in a good electrification state to obtain environmental stability by any of these coupling treatments, it is more preferable that the property be made significant, as the treatment with the titanium-based coupling agent is made. It is inferred that this is because the base material of the coupling agent has a good affinity, which base material also contains titanium.

As the coupling agent for the hydrophobicity-providing treatment, the following can be listed as specific examples.

As tintanate-based coupling agents: isopropyltriisostearoyltitanate, isopropyltris (dioctylpyrophosphate)titanate, isopropyltri(N-aminoethyl-aminoethyl)titanate, tetraoctylbis(ditridecylphosphite)

titanate, tetra(2,2-diallyloxymethyl-1-butyl)bis(ditridecyl) phosphitetitanate, bis(dioctylpyrophosphphate) oxyacetatetitanate, bis(dioctylpyrophosphphate) ethylenetitanate, etc. are listed.

As silicone-based coupling agents: dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, P-chloroethyltrichlorosilane, chloromethyldimethylchlorosilane, chloromethyltrichlorosilane, P-chlorophenyltrichlorosilane, 3-chloropropyltrichlorosilane, 3-chloropropyltrimethoxysilane, vinyltriethoxysilane, vinylmethoxysilane, vinyl-tris(β-methoxyethoxy)silane, γ-methacryloxypropyltrimethoxysilane, vinyltriacetoxysilane, divinyldichlorosilane, dimethylvinylchlorosilane, octyl-trichlorosilane, decyl-trichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyltrimethoxysilane, hexamethyldisilazane, hexaethyldisilazane, diethyltetramethyldisilazane, hexaphenyldisilazane, hexatolyldisilazane, N-(2-aminoethyl)3-aminopropylmethyldimethoxysilane, N-(2-aminoethyl)3-aminopropyltrimethoxysilane, 3-aminopropyltriethoxysilane, etc. are listed.

As an aluminum-based coupling agent: acetoalkoxyaluminumdiisopropylate, etc. are listed.

Next, a binder resin as a base material that can be employed for the toner according to the present invention will be explained. It is preferable that polyester resin of which a raw material is an alkyleneoxide adduct of bisphenol A of the following formula (1) be employed as a binder. Polyester resin employing the monomer is preferred, since there is a little decomposition by flash-fixing and little odor is emitted. Further, styreneacrylic resin, epoxy resin and polyether polyol resin, etc. can be mixed to be employed with this polyester resin. Furthermore, if necessary, polyethylene and polypropylene, etc. employed for a general toner may be combined. Due to these, fixing strength is drastically increased and also a developer that is stable over a long period can be obtained.

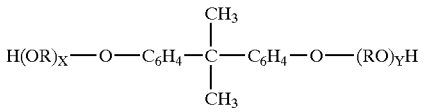

(1)

(In the formula described above, R represents an ethylene or propylene group and X, Y represent integers equal to or more than 1, respectively.)

With respect to the binder of the polyester resin, for example, materials described in Japanese Laid-Open Patent Application No. 62-291668 and U.S. Pat. No. 4,804,622 can be employed. For example, ethylene or propyrene oxide adduct of bisphenol A can be provided as an alcohol component and terephthalic acid can be provided as an acid component. Furthermore, a crosslinking agent may be employed and, for example, trimellitic acid can be employed. It is preferable that the glass transition temperature of polyester resin be equal to or more than 60° C., and in the case of being a toner, equal to or more than 58° C. This is because solidification is prevented in time of transportation, etc.

Further, as the polyester resin, preferable is one in which the alcohol component includes bisphenol A alkylene oxide adduct being equal to or more than 80 molar %, more preferable being equal to or more than 90 molar %, and further preferable being equal to or more than 95 molar %. An amount of the bisphenol A alkylene oxide adduct is less than 80 molar % is not preferred since usage of the monomer causes generation of relatively much oder.

As the alcohol component employed in the polyester resin, for example, polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl) propane, etc. can be listed.

Among these, preferable are polyoxypropylene(2.2)-2,2-bis(4-hydroxyphenyl)propane, polyoxyethylene(2.2)-2,2-bis(4-hydroxyphenyl)propane, polyoxyethylene(2.0)-2,2-bis(4-hydroxyphenyl)propane, etc.

These may be employed singularly or by mixing equally two or more kinds. Also, if necessary, another alcohol component can be used in combination with the above-mentioned compound. For example, diols such as ethylene glycol, diethylene glycol, triethylene glycol, 1,2-propylene glycol, 1,3-propylene glycol, 1,4-butanediol, neopentylglycol, 1,4-butenediol, 1,5-pentanediol, 1,6-hexanediol, etc., and other dihydric alcohols such as bisphenol A, hydrogenated bisphenol A, etc. can be added. As a tri- or more-hydric alcohol component, sorbitol, 1,2,3,6-hexanetetrol, 1,4-sorbitan, pentaerythritol, dipentaerythritol, tripentaerythritol, 1,2-butanetriol, 1,2,5-pentanetriol, glycerol, 2-methylpropanetriol, 2-methyl-1,2,4-butanetriol, trimethylolethane, trimethylolpropane, and other tri- or more-hydric alcohols can be listed.

As an acid component employed for the polyester resin, terephthalic acid, isophthalic acid, orthophthalic acid, or anhydrides thereof, etc. can be listed, and preferably being terephthalic acid/isophthalic acid. A single one of these may be employed or two or more kinds of these mixed may be employed. Also, another acid component can be used in combination with the compound to the extent that odor with regard to the flash-fixing is not a problem. For example, maleic acid, fumaric acid, citraconic acid, itaconic acid, glutaconic acid, cyclohexanedicarboxylic acid, succinic acid, adipic acid, sebatic acid, azelaic acid, and malonic acid, etc. can be listed, and moreover, alkyl or alkenylsuccinic acid such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, and isododecenylsuccinic acid, etc., or anhydrides and lower alkylesters of these acids, and other dihydric carboxylic acids can be listed. Furthermore, in order to provide a crosslinkage to polyester, a tri- or more-hydric carboxylic acid component can be also mixed and employed as another acid component. As a tri- or more-hydric carboxylic acid component, 1,2,4-benzenetricarboxilic acid, 1,3,5-benzenetricarboxilic acid, other polycarboxylic acids and anhydrides thereof can be listed.

Moreover, in order to accelerate a polyester resin formation reaction, generally used esterification catalysts, for example, zinc oxide, tin protoxide, dibutyl tin oxide, and dibutyl tin dilaurate, etc. can be used.

When the toner according to the present invention is a color toner, selecting from an aminium, diimmonium, naphthalocyanine, and tin oxide as the combined infrared-ray absorbent is recommended, most preferable is diimmonium in that its absorption efficiency of infrared-rays is higher, and its amount to be added can be drastically reduced compared to a conventional color toner.

Moreover, improvement of fixing property in flash light exposure and prevention of a defect in printing called as a void can be provided by adding a compound represented by the following formula (2) as a fixing auxiliary to the present toner. The amount of this fixing auxiliary to be added is desirably 0.01 through 10 parts by weight and more desirably 0.5 through 5 parts by weight to 100 parts by weight of a binder resin.

$$C—[CH_2—O—CO—(CH_2)_n—CH_3]_4 \quad (2)$$

(n is an integer equal to or more than 14.)

As a colorant for use in the present toner, the conventional ones can be widely employed and, for example, aniline blue (C. I. No. 50405), calco oil blue (C. I. No. azoic Blue 3), chrome yellow (C. I. No.14090), ultramarine blue (C. I. No.77103), Dupont oil red (C. I. No.26105), quinoline yellow (C. I. No.47005), methylene blue-chloride (C. I. No.52015), phthalocyanine blue (C. I. No.74160), malachite green-oxalate (C. I. No.42000), lampblack (C. I. No.77266), rose bengal (C. I. No.45435), ECR-181 (Pg.No122) and a mixture of these, etc. can be employed.

The usage amount of the above colorant is normally 0.1 through 20 parts by weight to 100 parts by weight of the binder resin, and particularly 0.5 through 10 parts by weight is preferable.

Furthermore, the toner according to the present invention can be employed with mixing a white inorganic fine particle such as a flow behavior improving agent, etc. For the present toner, since the above titanium black fine particle is externally added to a surface of the toner particle, improvement of flow behavior and electrostatic property of the toner is essentially achieved. Thus, the inorganic fine particle herein is employed for an adjustment of the flow behavior, etc., of the toner.

The proportion of the inorganic fine particle mixed into the toner is 0.01 through 5 parts by weight, preferably 0.01 through 2.0 parts by weight. As such an inorganic fine particle, for example, a silica fine particle, alumina, titanium oxide, barium titanate, magnesium titanate, calcium titanate, strontium titanate, zinc oxide, silica sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, silicon nitride, etc. are listed, and the silica fine particle is particularly preferable.

The toner can be employed directly as a one-component developer or as a two-component developer to which a carrier is added. In case of being employed as a two-component developer, it is preferable to employ a resin-coated ferrite or iron powder carrier. In the case of employing a ferrite, at least manganese is included, magnetization at 10 kOe is 75 through 100 emu/g, and it is desirable to employ a carrier covered in the ratio of 0.5 through 3 wt % to 100 wt % of a carrier core. As a carrier-covering agent, acrylic, styrene, urethane, etc. besides silicone can be employed. For the particle diameter of a carrier core material, an average particle diameter of 30 through 100 $\mu$m is preferred, and in particular, that of 60 through 90 $\mu$m is recommended. This is because if the average diameter is less than 20 $\mu$m, fine particles increase in the distribution of carrier particles so that magnetization per particle is lowered and scattering of the carrier becomes significant. To the contrary, an average particle diameter of carriers over 100 $\mu$m is not preferred since the specific surface area is lowered and scattering of the toner occurs. A solvent used for forming a carrier-covering resin layer is toluene, xylene, methyl ethyl ketone, methyl isobutyl ketone, cellosolvutyl acetate, etc.

Regarding a method for forming a covering resin layer on the carrier core material, after the coating resin is dissolved into a solvent, and after the carrier core material is coated with an identical resin solution homogeneously by an immersion method, a spray method, brush application, etc, the solvent is evaporated by drying to manufacture a carrier by way of trial. Herein, if necessary, burning may be performed. As a burning apparatus, either an external heating system or an internal heating method may be allowed, for example, a fixed type or fluid type electric furnace, a rotary type electric furnace, and a burner furnace may be allowed, or burning with microwaves may be allowed. For a burning temperature, 180 through 300° C. are preferable, and particularly, 220 through 280° C. are most appropriate. At equal to or less than 180° C., solidification cannot fully be realized, while at a temperature over 300° C., a portion of resin may be decomposed so that a surface layer of the resin may become rough so as not to obtain a homogeneous covering layer.

The fixing method in an image formation apparatus using the toner can be applicable to the flash-fixing and the heat-roll fixing, and employment in the flash-fixing in which sublimation is frequent is more desirable.

The toner as a developer may be magnetic or non-magnetic and may be a back-exposure system, in which development is made by light exposure from backside of a photoconductor to a development part. Furthermore, as a photoconductor, generally an inorganic photoconductor such as amorphous silicon, selenium, etc., and an organic photoconductor such as polysilane, phthalocyanine, etc. can be employed, and particularly an amorphous silicon photoconductor is preferred due to its long service life.

In an image formation method including a process in which a toner image on a recording medium is fixed on a surface thereof by flash exposure, energy of the flash light is 0.5 through 3.0 J/cm$^2$, luminous time is 500 through 3000 $\mu$s, and the toner having a composition as described above is employed, thereby, an image can be formed at a high fixing rate.

(Embodiment)

A manufacturing process of a toner in the embodiment and the result of an image fixing test when a two-component developer is provided by adding a carrier to this toner will be explained below. Herein, the following Table 1 shows employed titanium black fine particles, Table 2 shows compositions and test results when color toners are provided, and table 3 shows compositions and test results when black toners are provided.

(Treatment of the Titanium Black Fine Particle with a Coupling Agent)

20 g of particulate titanium black was added to a solution including 0.02 g of a coupling agent and 500 g of n-hexane with stirring and the stirring was continued further for 1 hour. Subsequently, the solution was filtrated, and heated and dried for 3 hours at 100° C., to obtain titanium black fine particles of which the surface was subjected to a hydrophobicity-providing treatment with a coupling agent. By this method, titanium black fine particles treated with titanate-based, silicone-based, and aluminum-based coupling agents were manufactured. The result is shown in Table 1.

Herein, in Table 1, titanium blacks of the present embodiment are shown as titanium black No. 1 through No. 7. These first-order particle diameters are in 0.005 μm through 0.04 μm and these color changing temperatures (from black to white) are 70° C. through 120° C., being equal to or less than 200 ° C.

Furthermore, M-1, S-1, 20M, and 13R shown in Table 1 are names of articles of available titanium blacks. For these conventional titanium blacks, the hydrophobicity-providing treatment was not provided and color changing temperatures from black to white are shown for comparison. The color changing temperatures are in the range of 240° C. through 500° C. so that the color changing cannot be accomplished with the usual flash exposure energy and the color remains black. Thus, they are not suitable as titanium black fine particles used in the present invention.

(Manufacture of a Carrier)

2 wt % of acrylic resin (name of article: BR-85 made by Mitsubishi Rayon Co., Ltd.) was coated onto a carrier core material using a fluidized bed and was dried, wherein a manganese ferrite particle with 60 μm (Powdertech Corp.) was provided as the core material, to obtain a manganese ferrite carrier covered with the acrylic resin.

(Manufacture of the Toners of the Embodiment)

(1) Color Toners 1 Through 12

According to the compositions shown in Table 2, after toner compositions (a binder, a colorant, a charge control agent, a fixing auxiliary, and an infrared-ray absorbent) were thrown into a Henschel mixer and preparative mixing was finished, kneading by a extruder, subsequent roughly size reduction by a hammer mill, finely size reduction by a jet mill, and classification by an air shifter were performed to obtain a colored fine particle with a volume-average particle diameter of 8.5 μm. Subsequently, the titanium black fine particle was subjected to an external addition treatment to the toner particle by a Henschel mixer to obtain a color toner.

Herein, the binder was the polyester No. 1. Dupont oil red as the colorant, P-51 made by Orient Chemical Corp. as the charge control agent, and WEP-made by Nihon Yusi as the fixing auxiliary were employed. This WEP-5 is a compound represented by the formula (2) described above and n=20. The infrared-ray absorbent was selected from an aminium, a diimmonium, naphthalocyanine, and tin oxide.

Employed external additives were the titanium blacks No. 3, No. 6, and No. 7, and the tests were also performed for the conventional titanium blacks M-1, S-1, 20M, and 13R.

TABLE 1

| Titanium black particles | | | | | |
|---|---|---|---|---|---|
| Kinds | Coupling agent | Coupling agent maker | First-order particle diameter (μm) | Color changing temperature (black → white) | Manufacturer |
| Titanium Black No.1 | dimethyldichlorosilane | Shinetsu Silicone | 0.005~0.04 | 110° C. | Ako Kasei |
| Titanium Black No.2 | bromomethyldimethylchlorosilane | Shinetsu Silicone | 0.005~0.04 | 120 | Ako Kasei |
| Titanium Black No.3 | isopropyltriisostearoyltitanate | Nisso | 0.005~0.04 | 115 | Ako Kasei |
| Titanium Black No.4 | isopropyltri(N-aminaethyl-aminoethyl) titanate | Nisso | 0.005~0.04 | 115 | Ako Kasei |
| Titanium Black No.5 | acetoalkoxyaluminumdiisopropylate | Ajinomoto | 0.005~0.04 | 120 | Ako Kasei |
| M-1 | — | — | 0.3~0.4 | 500 | Ishihara Sangyo |
| S-1 | — | — | 0.1~0.15 | 350 | Ishihara Sangyo |
| 20M | — | — | 0.02~0.2 | 240 | Mitsubishi Material |
| 13R | — | — | 0.02~0.2 | 250 | Mitsubishi Material |
| Titanium Black No.6 | isopropyltriisostearoyltitanate | Nisso | 0.005~0.02 | 80 | Ako Kasei |
| Titanium Black No.7 | isopropyltriisostearoyltitanate | Nisso | 0.005~0.01 | 70 | Ako Kasei |

(Manufacture of Binder Resin)

Polyester No. 1 was manufactured as a binder by the following process.

1.0 mol of polyoxypropylene(2.2)-2,2-bis(4-hydroxyphenyl)propane, 9.0 mol of polyoxyethylene(2.2)-2,2-bis(4-hydroxyphenyl)propane, 4.6 mol of terephthalic acid, 4.6 mol of isophthalic acid, and 5.0 g of dibutyl tin oxide were put into a four-necked flask, and a thermometer, a stainless-made stirring bar, an efflux-type condenser, and a nitrogen inducing tube were installed. Reaction was made for 3 hours at 220° C., for 3 hours at 240° C. under nitrogen gas flow, and further for 2 hours at the same temperature under reduced pressure being 60 mmHg (approximately 7999 Pa), in a mantle heater, and the reaction was finished.

(2) Black Toners 13 Through 28

According to the compositions shown in Table 3, after toner compositions (a binder, a colorant (carbon black), a charge control agent, and a fixing auxiliary) were thrown into a Henschel mixer and preparative mixing was finished, kneading by a extruder, subsequent roughly size reduction by a hammer mill, finely size reduction by a jet mill, and classification by an air shifter were performed to obtain a colored fine particle with a volume-average particle diameter of 8.5 μm. Subsequently, an external addition treatment with an external additive was performed by a Henschel mixer to obtain a black toner.

Herein, the binder was the polyester No. 1. Carbon Pritex 150T made by Degussa as the carbon black, P-51 made by Orient Chemical Corp. as the charge control agent, and WEP-5 made by Nihon Yusi as the fixing auxiliary were employed.

Evaluation tests were performed with respect to the titanium blacks No. 1, No. 2, No. 3, No. 4, and No. 5. Furthermore, the tests for comparisons were also performed for the case of adding the conventional silica HVK2150 singularly, for the case of addition in combination with the silica HVK2150, and for white titanium oxide ST30.

(Printer Initial Evaluation Test Examples)

For the evaluation, a developer in which 4.5 wt % of the toner was mixed to 95.5 wt % of the carrier was employed. The results of the evaluation are shown in Table 2 for the color toners and in Table 3 for the black toners.

For the evaluation for flash fixing-property in this case, a high-speed printer F6760D (made by Fujitsu Limited) was employed to research fixing property and electrification change from high temperature and high humidity to low temperature and low humidity. The process rate of the printer is 1200 mm/s.

(1) For the fixing property (release property), when a mending tape (SCOTCH) was applied on a printing sample with the load of 600 g and the toner was peeled, the case of printing density maintained at equal to or more than 80% of that before peeling was determined to be suitable (that is represented by adding G in the Tables), and that of lower than it was determined to be unsuitable (that is represented by adding NG in the Tables).

(2) The amount of charge was measured by a magnetic blow off method, and the value of high temperature and high humidity/low temperature and low humidity equal to or more than 0.8 was determined to be suitable and that of lower than it was determined to be unsuitable.

TABLE 2

| | | Color toners | | | | | | |
|---|---|---|---|---|---|---|---|---|
| | | Maker | Toner 1 | Toner 2 | Toner 3 | Toner 4 | Toner 5 | Toner 6 |
| (Part 1) | | | | | | | | |
| Binder | Polyester No. 1 | Manufactured in house | 94.5 | 94.5 | 94 | 94 | 94 | 94 |
| Colorant | Dupont oil red | Dupont | 5 | 5 | 5 | 5 | 5 | 5 |
| Charge control agent | P-51 | Orient Chemical | 0.5 | 0.5 | 0.5 | 0.5 | 0.5 | 0.5 |
| Fixing auxiliary | WEP-5 | Nihon Yusi | 2 | 2 | 2 | 2 | 2 | 2 |
| Infrared-ray | Aminium | Imperperial Chemical | | | 0.5 | | | |
| absorbent | Diimmonium | Imperial Chemical | | | | 05 | | |
| | Naphthalocyanine | Yamamoto Chemical | | | | | 0.5 | |
| | Tin oxide | Kanto Denka | | | | | | 0.5 |
| External additive | Silica HVK2150 | Clariant | 0.2 | 0.2 | 0.2 | 0.2 | 0.2 | 0.2 |
| | Titanium Black No. 3 | Ako Kasei | 0.5 | 0 | 0.5 | 0.5 | 0.5 | 0.5 |
| | M-1 | Ishihara Sangyo | | | | | | |
| | S-1 | Ishihara Songyo | | | | | | |
| | 20M | Mitsubishi Material | | | | | | |
| | 13R | Mitasbishi Material | | | | | | |
| | Titanium Black No. 6 | Ako Kasei | | | | | | |
| | Titanium Blent No. 7 | Ako Kesei | | | | | | |
| | White titanium oxide STT30 | Titan Kagyo | | 0.5 | | | | |
| | Flush fixing rate (%) | | 85G | 55NG | 95G | 98G | 90G | 90G |
| Charge quanity (μc/g) | High temperature and high humidity (35° C., 80% RH | | 17.2 | 17.4 | 18 | 19 | 17.5 | 18.6 |
| | Ordinary temperature and ordinary humidity (25° C., 50% RH) | | 20.3 | 20.3 | 20.3 | 20.3 | 20.3 | 20.3 |
| | Low temperature and low humidity (5° C., 10% RH) | | 21.6 | 21.8 | 21.7 | 21.9 | 21.6 | 22.69 |
| | High temperature and high humidity/ Low temperature and low humidity | | 0.80G | 0.80G | 0.83G | 0.87G | 0.81G | 0.82G |

| | | Maker | Toner 7 | Taner 8 | Toner 9 | Toner 10 | Toner 11 | Toner 12 |
|---|---|---|---|---|---|---|---|---|
| (Part 2) | | | | | | | | |
| Binder | Polyester No. 1 | Manufactured in house | 94 | 94 | 94 | 94 | 94 | 94 |
| Colorant | Dupont oil red | Dupont | 5 | 5 | 5 | 5 | 5 | 5 |
| Charge control agent | P-51 | Orient Chemical | 0.5 | 0.5 | 0.5 | 0.5 | 0.5 | 0.5 |
| Fixing auxiliary | WEP-5 | Nihon Yusi | 2 | 2 | 2 | 2 | 2 | 2 |
| Infrared-ray absorbent | Aminuim | Imperial Chemical | | | | | | |
| | Diimmonium | Imperial Chemical | 0.5 | 0.5 | 0.5 | 0.5 | 0.5 | 0.5 |
| | Naphthalocyanine | Yamamoto Chemical | | | | | | |
| | Tin oxide | Kanto Denka | | | | | | |
| External additive | Silica HVK2150 | Clariant | 0.2 | 0.2 | 0.2 | 0.2 | 0.2 | 0.2 |
| | Titanium Black No. 3 | Ako Kasei | | | | | | |
| | M-1 | Ishihara Sangyo | 0.5 | | | | | |

TABLE 2-continued

| | | Color toners | | | | | | |
|---|---|---|---|---|---|---|---|---|
| | S-1 | Ishihara Sangyo | | 0.5 | | | | |
| | 20M | Mitsubishi Material | | | 0.5 | | | |
| | 13R | Mitsubishi Material | | | | 0.9 | | |
| | Titanium Black No. 6 | Ako Kasei | | | | | 0.5 | |
| | Titanium Black No. 7 | Ako Kasei | | | | | | 0.5 |
| | White titanium oxide STT30 | Titan Kogyo | | | | | | |
| | Flush fixing rate (%) | | 60NG | 62NG | 70NG | 70NG | 100G | 100G |
| Charge quanity (μc/g) | High temperature and high humidity (35° C., 80% RH) | | 17.2 | 18.2 | 15.9 | 16.3 | 18.9 | 19.4 |
| | Ordinary temperature and ordinary humidity (25° C., 50% RH) | | 20.3 | 20.3 | 20.3 | 20.3 | 20.3 | 20.3 |
| | Low temperature and low humidity (5° C., 10% RH) | | 22.69 | 22.2 | 23.5 | 22.8 | 23 | 24 |
| | High temperature and high humidity/ Low temperature and low humidity | | 0.76NG | 0.82G | 0.68NG | 0.71NG | 0.82G | 0.81G |

TABLE 3

| | | Black toner | | | | | | | |
|---|---|---|---|---|---|---|---|---|---|
| | | Maker | Toner 13 | Toner 14 | Toner 15 | Toner 16 | Toner 17 | Toner 18 | Toner 19 |
| (Part 1) | | | | | | | | | |
| Binder | Polyester No. 1 | Manuractured in house | 89.5 | 89.5 | 89.5 | 89.5 | 89.5 | 89.5 | 89.5 |
| | Styrene - acrylic TB-1000 | Sanyo Chemical | | | | | | | |
| Colorant | Carbon Printex 150T | Degussa | 10 | 10 | 10 | 10 | 10 | 10 | 10 |
| Charge Control agent | P-51 | Orient Chemical | 0.5 | 0.5 | 0.5 | 0.5 | 0.5 | 0.5 | 0.5 |
| Fixing auxiliary | WEP-5 | Nihon Yusi | 0.5 | 0.5 | 0.5 | 0.5 | 0.5 | 0.5 | 0.5 |
| External additive | Silica HVK2150 | Clariant | 0.1 | 0.5 | 1 | 1.5 | | | |
| | Titanium Black No. 1 | Ako Kasei | | | | | | | |
| | Titanium Black No. 2 | Ako Kasei | | | | | | | |
| | Titanium Black No. 3 | Ako Kasei | | | | | 0.1 | 0.5 | 1 |
| | Titanium Black No. 4 | Ako Kasei | | | | | | | |
| | Titanium Black No. 5 | Ako Kasei | | | | | | | |
| | White titanium oxide STT30 | Titan Kogyo | | | | | | | |
| | Flush fixing rata (%) | | 95G | 90G | 60NG | 30NG | 95G | 93G | 90G |
| Charge quanity (μc/g) | High temperature and high humidity (35° C., 80% RH) | | 17.9 | 16.5 | 13.5 | 10.2 | 19.4 | 18.8 | 18.9 |
| | Ordinary temperature and ordinary humidity (25° C., 50% RH) | | 20 | 19.5 | 18.5 | 17.5 | 20.1 | 20.5 | 20.6 |
| | Low temperature and low humidity (5° C., 10% RH) | | 22.8 | 21.3 | 20.1 | 19 | 22.1 | 21.3 | 22.6 |
| | High temperature end high humidity/ Low temperature and low humidity | | 0.79NG | 0.77NG | 0.67NG | 0.54NG | 0.88G | 0.88G | 0.84G |

| | | Maker | Toner 20 | Toner 21 | Toner 22 | Toner 23 | Toner 24 | Toner 25 | Toner 26 |
|---|---|---|---|---|---|---|---|---|---|
| (Part 2) | | | | | | | | | |
| Binder | Polyester No. 1 | Manufactured in house | 89.5 | 89.5 | 89.5 | 89.5 | 89.5 | 89.5 | 89.5 |
| | Styrene - acrylic TB-1000 | Sanyo Chemical | | | | | | | |
| Colorant | Carbon Printex150T | Degussa | 10 | 10 | 10 | 10 | 10 | 10 | 10 |
| Charge control agent | P-51 | Orient Chemical | 0.5 | 0.5 | 0.5 | 0.5 | 0.5 | 0.5 | 0.5 |
| Fixing auxiliary | WEP-5 | Nihon Yusi | 0.5 | 0.5 | 0.5 | 0.5 | 0.5 | 0.5 | 0.5 |
| External additive | Silica HVK2150 | Clariant | | 0.5 | | | | | |
| | Titanium Black No. 1 | Ako Kasei | | | 1 | | | | |
| | Titanium Black No. 2 | Ako Kasei | | | | 1 | | | |
| | Titanium Black No. 3 | Ako Kasei | 1.5 | 0.5 | | | | | |
| | Titanium Black No. 4 | Ako Kasei | | | | | 1 | | |
| | Titanium Black No. 5 | Ako Kasei | | | | | | 1 | |
| | White titanium oxide STT30 | Titan Kogyo | | | | | | | 1 |
| | Flush fixing rate (%) | | 90G | 90G | 90G | 90G | 90G | 90G | 60NG |
| Charge | High temperature and high humidity | | 19.3 | 19.3 | 23.2 | 22.1 | 19.9 | 20.7 | 22.3 |

TABLE 3-continued

| | | Black toner | | | | | | |
|---|---|---|---|---|---|---|---|---|
| quantity ($\mu$c/g) | (35° C., 80% RH) Ordinary temperature and ordinary humidity | 20.6 | 20.3 | 25 | 23.3 | 21.6 | 22.6 | 25.3 |
| | (25° C., 50% RH) Low temperature and low humidity | 23.1 | 20.6 | 28.3 | 27.3 | 22.6 | 25.9 | 27.9 |
| | (5° C., 10% RH) High temperature and high humidity/ Low temperature and low humidity | 0.84G | 0.94G | 0.82G | 0.81G | 0.88G | 0.80G | 0.80G |

In case of the color toners shown in Table 2, it can be confirmed that the toners (1, 3, 4, 5, 6, 11, and 12) of the embodiment exhibit high fixing properties. It can be also confirmed that there is no problem for the electrostatic property and excellence is provided for environmental stability.

In case of the black toners shown in Table 3, it can be confirmed that the toners (17 through 25) of the embodiment exhibit high fixing properties.

It can be also confirmed that there is no problem for the electrostatic property and excellence is provided for environmental stability.

Although the preferred embodiment according to the present invention has been described above in detail, the present invention is not limited to such particular embodiment and various modifications and changes are allowed within the range of the content of the present invention described in the claims.

As is clear from the above detailed description, according to the present invention, when fixing is performed by flash light, since a black titanium black fine particle adheres to the surface of a toner particle, light energy is efficiently converted to heat so that the toner is fixed on a recording medium, and by a temperature rise at that time, the color of the titanium black fine particle changes from black to white. Thus, an image after fixing is not made turbid with black. Furthermore, if the titanium black fine particle is subjected to hydrophobicity-providing treatment, environmental stability of the toner is improved and a good electrostatic property can be maintained over a long period.

Moreover, as polyester resin is employed as a binder, since there is a little decomposed product and little odor is generated due to the fixing by flash light, a preferable toner can be provided, and additionally the fixing property can be improved by adding a certain fixing auxiliary. When a color toner is provided, the amount of an infrared-ray absorbent can also be reduced.

Therefore, fixing of a high quality image can be efficiently performed utilizing the color change of the titanium black added to the surface of the toner particle.

What is claimed is:

1. A toner comprising:

titanium black fine particles adhered to a surface of said toner, said titanium black fine particles change color from black to white upon exposure to flash light; and said titanium black fine particles are subjected to a hydrophobicity-providing treatment with a titanate-based, silicone-based, or aluminum-based coupling treatment agent.

2. The toner as claimed in claim 1, wherein an average first order particle diameter of the titanium black fine particle is 0.005 through 0.04 $\mu$m.

3. The toner as claimed in claim 1, wherein said titanium black fine particles change color from black to white at a temperature within a range of from 70 through 200° C.

4. The toner as claimed in claim 1, said toner further comprising at least a polyester resin of which a raw material is an alkylene oxide adduct of bisphenol A represented by the following formula (1):

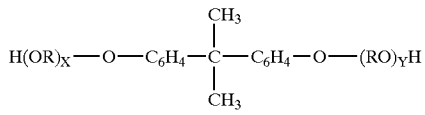

(1)

wherein R represents an ethylene or propylene group and X and Y represent integers equal to or more than 1, respectively, in the formula.

5. The toner as claimed in claim 1, said toner further comprising 0.01 through 10 parts by weight of a compound represented by the following formula (2):

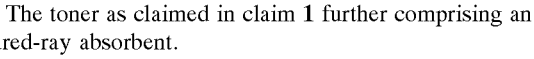

(2)

wherein n is an integer equal to or more than 14, per 100 parts by weight of a binder resin.

6. The toner as claimed in claim 1 further comprising an infrared-ray absorbent.

7. The toner as claimed in claim 6, wherein said infrared-ray absorbent is one selected from the group consisting of aminium, diimmonium, naphthalocyanine, and tin oxide.

8. A toner comprising:

titanium black fine particles adhered to a surface of said toner, said titanium black fine particles change color from black to white upon exposure to flash light; and an infrared-ray absorbent selected from the group consisting of aminium, diimmonium, naphthalocyanine, and tin oxide.

* * * * *